United States Patent [19]

Reedy

[11] Patent Number: 5,037,326

[45] Date of Patent: Aug. 6, 1991

[54] SEALED GROMMET MOUNTING FOR LAMP SOCKET

[75] Inventor: Patrick J. Reedy, Austintown, Ohio

[73] Assignee: General Motors Corporation, Detroit, Mich.

[21] Appl. No.: 540,600

[22] Filed: Jun. 12, 1990

[51] Int. Cl.[5] ..... H01R 13/73

[52] U.S. Cl. ..... 439/556; 439/549; 439/559; 174/153 G; 6/2

[58] Field of Search ..... 439/549, 552, 554–556, 439/559, 561, 567, 56, 587; 174/65 G, 152 G, 153 G; 16/2; 248/56

[56] References Cited

U.S. PATENT DOCUMENTS

| | | | |
|---|---|---|---|
| 2,664,458 | 12/1953 | Rapata | 174/153 G |
| 2,705,308 | 3/1955 | Howard | 174/153 G |
| 3,231,300 | 1/1966 | Moroney | 174/153 G |
| 4,086,483 | 4/1978 | Freund et al. | 174/153 G |
| 4,282,627 | 8/1981 | Downing | 16/2 |
| 4,299,363 | 11/1981 | Datschefski | 16/2 |

FOREIGN PATENT DOCUMENTS

| | | | |
|---|---|---|---|
| 1111742 | 4/1956 | France | 16/2 |

*Primary Examiner*—Larry I. Schwartz
*Assistant Examiner*—Julie R. Daulton
*Attorney, Agent, or Firm*—F. J. Fodale

[57] ABSTRACT

A lamp socket includes a housing in the form of an elastomeric grommet that passes through a round hole of a panel to mount the lamp socket to the panel. The grommet has a head at one end that has an outer diameter that exceeds the diameter of the hole and engages the back side of the panel when the head is inserted through the hole. The outer portion of the head consists of a plurality of thick oblique ribs that fold inwardly to reduce the outer diameter of the head responsive to twisting movement of the head in the hole so that a relatively low engage force passes the head through the hole. The grommet further includes a conical shoulder which sealingly engages the front side of the panel and clamps the lamp socket in place.

13 Claims, 1 Drawing Sheet

SEALED GROMMET MOUNTING FOR LAMP SOCKET

BACKGROUND OF THE INVENTION

This invention relates generally to elastomeric grommets and more specifically to elastomeric grommets having a head at one end which is forced through a panel hole to mount the elastomeric grommet to the panel for passing a component through the panel hole.

Such grommets are disclosed for example in U.S. Pat. No. 2,705,308 issued to Forbes Howard Mar. 29, 1955 and in U.S. Pat. No. 4,675,937 issued to Seiji Mitomi June 30, 1987.

These grommets which are typical of prior art grommets are pushed axially into the panel hole until the panel is trapped between a head at one end of the grommet and a shoulder which is spaced rearwardly of the head. During this panel mounting procedure, the head is first compressed radially inwardly to fit through the panel hole and then expands radially outwardly after passing through the panel hole to engage the backside of the panel so as to retain the grommet against pull out. The head and shoulder also typically clamp the grommet in place on the panel.

The grommets exemplified by the U.S. Patents noted above typically have relatively high engage force requirements primarily due to the need to compress the head of the grommet as it is pushed through the panel hole. The need for a strong clamping force may also contribute significantly to the relatively high engagement force requirement. In addition these typical prior art grommets often do not have a very high retention force primarily because the retention force depends on expansion of the head and is therefore substantially related to engage force requirements. In other words, reduced engage force requirements are typically accompanied by a reduced retention force and vice-versa.

SUMMARY OF THE INVENTION

The object of this invention is to provide an improved elastomeric grommet that has relatively low engage force requirements while producing a relatively high retention force once it is inserted through a hole and mounted to a panel.

A feature of the invention is that the elastomeric grommet requires only a relatively low engage force when the elastomeric grommet is pushed through a panel hole with a twisting motion whereas the elastomeric grommet produces significantly higher retention forces when an axial force is applied to pull the elastomeric grommet out of the panel hole.

Another feature of the invention is that the elastomeric grommet produces substantial sealing or clamping forces when it is mounted on a panel even though it requires only a relatively low engage force.

Another feature of the invention is that the elastomeric grommet is mounted on a panel having a simple round hole.

Another feature of the invention is that the elastomeric grommet has a head which reduces in diameter responsive to a torsional force produced by a twisting motion of the elastomeric grommet when it is inserted through a panel hole.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
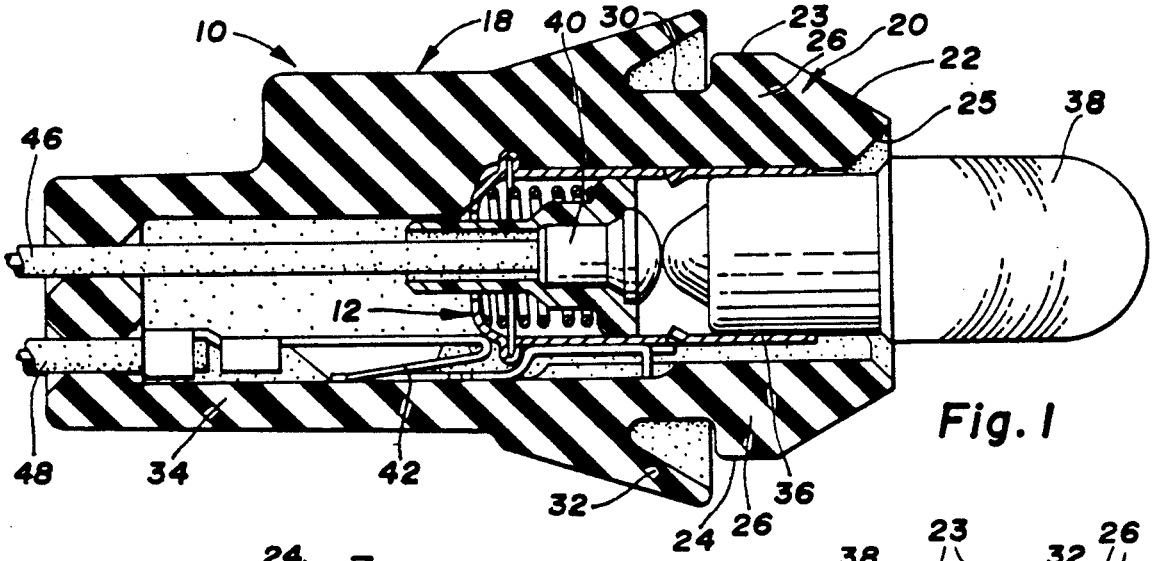
FIG. 1 is a longitudinal section of a lamp socket in which an elastomeric grommet in accordance with the invention is used as a housing of the lamp socket.

Referring now to the drawing, an elastomeric grommet 10 in accordance with this invention is illustrated as a housing for a lamp socket 12 but it should be understood that the elastomeric grommet 10 can be used to pass other components, such as electric or optic cables, fluid conduits or the like through a hole 14 that extends through a panel 16.

Figure 6:
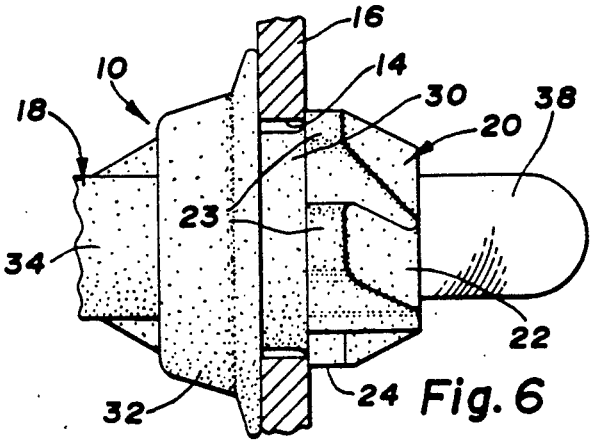
FIG. 6 is a fragmentary side view of the lamp socket showing the elastomeric grommet mounted to the panel.

The elastomeric grommet 10 is shaped and made of a suitable elastomeric material so that only a relatively low engage force is required to insert the elastomeric grommet 10 through the hole 14 whereas a relatively high retention force is produced to prevent the elastomeric grommet 10 from being unintentionally pulled out of the hole 14 once it is mounted to the panel 16 as shown in FIG. 6.

The elastomeric grommet 10 comprises an elongated body 18 that is preferably molded of a silicone rubber having an 'A' durometer in the range of 50–62. The elongated body 18 has a head 20 at one end that is inserted through the hole 14 extending through the panel 16 for engaging a back side of the panel 16. The head 20 is shaped to cooperate with a round hole of uniform diameter so that the hole 14 does not require any special shape.

Regarding its shape, the head 20, when viewed longitudinally as in FIGS. 1, 2, 4 and 6, has a tapered face 22 that leads to rearward concentric lands 23 uniformly spaced from the longitudinal axis of the elastomeric grommet 10. The minimum diameter of the tapered face 22 is considerably less than the uniform diameter of the hole 14 so that it freely inserts partway into the hole 14. On the other hand, the concentric lands 23 define an outer diameter 24 of the head that exceeds the uniform diameter of the round hole 14 by a substantial amount so that the head 20 produces a relatively high retention force after it is inserted through the round hole 14 and engages the back side of the panel 16 as shown in FIG. 6. For example, a head 20 having an outer diameter of 24.0 mm will produce a retention force in the range of 90N when it is inserted through a round 20.50 mm hole.

Figure 3:
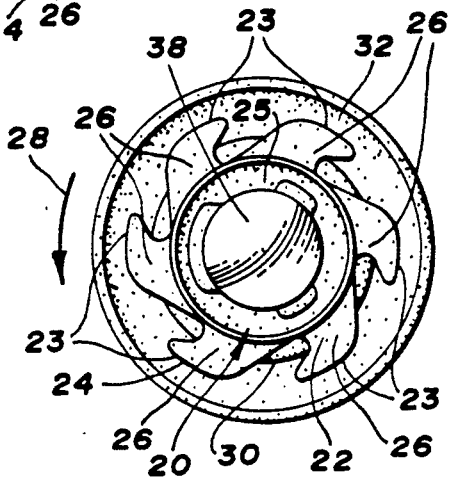
FIG. 3 is a front view of the lamp socket taken substantially along the line 3—3 of FIG. 2 looking in the direction of the arrows.
Figure 5:
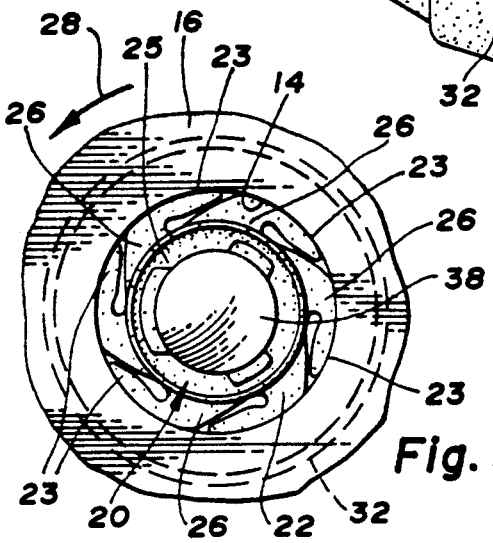
FIG. 5 is a front view of the lamp socket taken substantially along the line 5—5 of FIG. 4 looking in the direction of the arrows.

When viewed transversely as in FIGS. 3 and 5, the head 20 has an inner annular portion 25 and an outer portion consisting of six circumferentially spaced, thick oblique ribs 26 that are integrally attached to the inner annular portion 25 at their inner ends. The thick oblique ribs 26 form a majority of the tapered face 22 and the free ends of the thick oblique ribs 26 provide the concentric lands 23 that define the outer diameter of the head 20.

Figure 2:
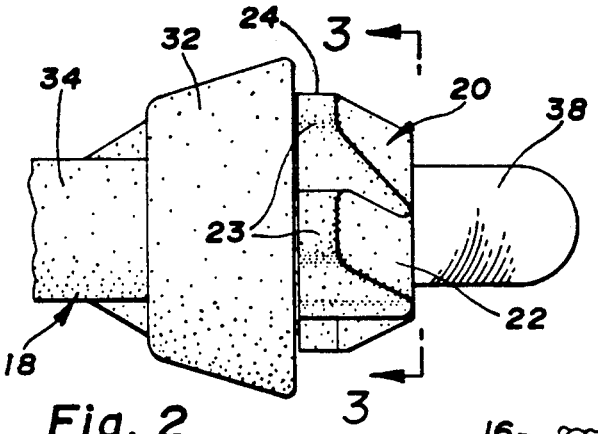
FIG. 2 is a fragmentary side view of the lamp socket that is shown in FIG. 1.
Figure 4:
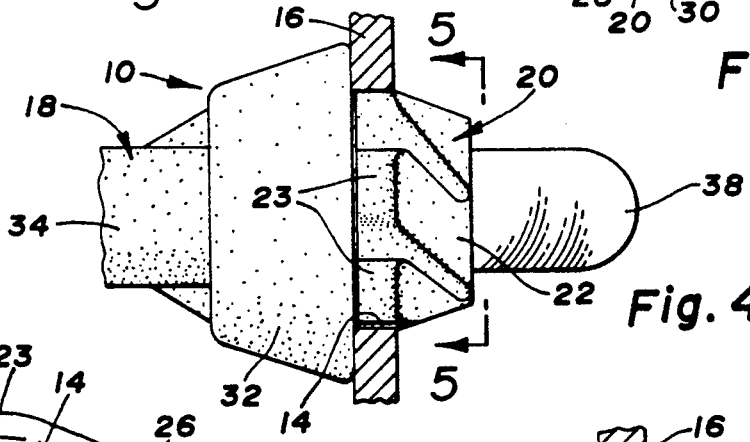
FIG. 4 is a fragmentary side view of the lamp socket showing the elastomeric grommet in the process of being mounted to a panel.

The thick oblique ribs 26 are shown in their free unstressed molded condition in FIGS. 2 and 3 where it is seen that the inner portions of the thick oblique ribs 26 are necked inwardly at their trailing sides. Thus these thick oblique ribs 26 fold inwardly toward each other in the trailing direction to reduce the outer diameter of the head 20 as shown in FIGS. 4 and 5. This inwardly folding occurs responsive to twisting movement of the head 20 in the round hole 14 in the counterclockwise direction indicated by the arrow 28 in FIGS. 3 and 5. This counterclockwise twisting applies a clockwise torsion to the tapered face 22 which folds the thick oblique ribs 26 inwardly and reduces the outer diameter of the head 20. Preferably the outer diameter is reduced to the diameter of the round hole 14 before the thick oblique ribs 26 engage each other as shown in FIG. 5. Thus the force required to insert the head 20 itself through the round hole 14 is essentially the force required to fold the thick oblique ribs 26 inwardly as the head 20 is pushed and twisted through the round hole 14. This component of the engage force is considerably less that the relatively high retention force of the thick oblique ribs 26 which is essentially the force required to shear off the tips of the oblique ribs 26 which are relatively thick as shown in FIG. 3. The other component of the engage force is the sealing or clamping force which is discussed later. However it should be noted that even when this is taken into account, the engage force required to pass the head 20 through the hole 14 and clamp the elastomeric grommet 10 to the panel 16 is still relatively low. For instance, an elastomeric grommet made in accordance with this invention and having a 24.00 mm head had the following characteristics when mounted in a round 20.50 mm hole. Engage force requirement 60N; clamping force 40N; retention force 90N.

The elongated body 18 further comprises a cylindrical neck 30 of reduced diameter behind the head 20 and a conical sealing shoulder 32 that is integrally attached to the elongated body 18 behind the cylindrical neck 30 so that it extends forward and outward toward the head 20. The cylindrical neck 30 is preferably sized so that it fits freely in the round hole 14 upon passage of the head 20 through the round hole 14 so as to avoid unnecessary additional engage force requirements. The conical sealing shoulder 32 is deflected at its outer rim into sealing engagement with the front side of the panel 16 when the cylindrical neck 30 is disposed in the round hole 14 and the head 20 engages the back of the panel 16 as shown in FIG. 6. This also provides the clamping force which holds the elastomeric grommet 10 in place on the panel 16.

The force which is required to deflect the rim of the conical sealing shoulder into sealing and clamping engagement with the front side of the panel 16 is a sealing and/or clamping force requirement that forms the second component of the engage force requirement. As mentioned above the engage force required to mount the elastomeric grommet 10 on the panel 16 is considerably less than retention force provided by the head 20 after it is pushed and twisted through the round hole 14. This is primarily due to the relatively low force required to push and twist the head 20 itself through the round hole 14 in comparison to prior art grommets requiring radial compression of the head. This low component of the overall engage force requirement allows the conical sealing shoulder 32 to provide increased sealing and/or clamping forces while maintaining a relatively low engage force requirement.

The elongated body 18 further includes a rearward section 34 behind the conical sealing shoulder 32 that, in this particular instance, is stepped in the longitudinal direction and rectangular in the transverse direction. The rearward section may take other shapes. However, it should be of such length and outline that it can be gripped manually to insert the head 20 into the round hole 14 and then simultaneously push and twist the head 20 through the round hole 14 until it engages the back side of the panel 16 as shown in FIG. 6.

As indicated above, the elastomeric grommet 10 in this particular disclosure of the invention forms the housing of a lamp socket 12. The lamp socket 12 comprises conventional components such as a socket shell 36 that receives and retains the base of lamp bulb 38, a spring loaded contact 40 that engages the positive contact of the lamp bulb 38, a ground contact 42 that engages the base of the lamp bulb 40 and electric cables 46 and 48 attached to the contacts 40 and 42 respectively.

I wish it to be understood that I do not desire to be limited to the exact details of construction shown and described, for obvious modifications will occur to a person skilled in the art.

The embodiments of the invention in which an exclusive property or privilege is claimed are defined as follows:

1. An elastomeric grommet for passing a component through a hole of a panel that requires a relatively low engage force while producing a relatively high retention force comprising;

an elongated body having a head at one end that inserts through a hole of uniform diameter extending through a panel for engaging a back side of the panel, the head having a tapered face that inserts into the hole and an outer diameter that exceeds the uniform diameter of the hole so that head engages the back side of the panel when the head is inserted through the hole to produce a relatively high retention force, the head having an outer portion comprising a plurality of ribs that are attached to an inner annular portion at their inner ends so that each rib extends radially from the inner annular portion and folds inwardly toward an adjacent rib in a trailing circumferential direction to reduce the outer diameter of the head responsive to twisting movement of the head in the hole so that a relatively low engage force passes the head through the hole, the elongated body having a cylindrical neck of reduced diameter behind the head that is sized to fit in the hole upon passage of the head through the hole, and the elongated body having a shoulder that is integrally attached to the elongated body behind the cylindrical neck and is shaped to engage a front side of the panel when the head is inserted through the hole in the panel to engage the backside of the panel.

2. The elastomeric grommet as defined in claim 1 wherein the elongated body has a rearward section behind the shoulder that can be gripped manually for inserting the head into the hole and pushing and twisting the head through the hole.

3. The elastomeric grommet as defined in claim 1 wherein the outer diameter of the head is such that the head cannot be pushed or pulled through the hole with a pure axial motion without destroying the head.

4. The elastomeric grommet as defined in claim 1 wherein the elastomeric grommet houses a lamp socket that includes a socket shell that is disposed inside and in engagement with the inner annular portion of the head, the socket shell being adapted to receive and retain a lamp bulb base.

5. An elastomeric grommet for passing a component through a hole of a panel that requires a relatively low engage force while producing a relatively high retention force comprising;

an elongated body having a head at one end that inserts through a round hole of uniform diameter extending through a panel for engaging a back side of the panel, the head having a tapered face that freely inserts part way into the hole and an outer diameter that exceeds the uniform diameter of the hole so that head engages the back side of the panel when the head is inserted through the hole to produce a relatively high retention force, the head having an inner annular portion and an outer portion comprising a plurality of thick oblique ribs that fold inwardly toward each other in a trailing circumferential direction to reduce the outer diameter of the head responsive to twisting movement of the head in the round hole so that a relatively low engage force passes the head through the round hole, the elongated body having a cylindrical neck of reduced diameter behind the head that is sized to fit freely in the hole upon passage of the head through the hole, and the elongated body having a conical sealing shoulder that is integrally attached to the elongated body behind the cylindrical neck and that extends forward and outward toward the head to sealingly engage a front side of the panel and clamp the elastomeric grommet to the panel when the head is inserted through the hole in the panel to engage the backside of the panel.

6. The elastomeric grommet as defined in claim 5 wherein the outer diameter of the head is such that the head cannot be pushed or pulled through the hole axially without destroying the head.

7. The elastomeric grommet as defined in claim 5 wherein the elongated body has a rearward section behind the conical sealing shoulder that can be gripped manually for inserting the head into the hole and twisting and pushing the head in the hole so that the head passes through the hole.

8. The elastomeric grommet as defined in claim 7 wherein the outer diameter of the head is such that the head cannot be pushed or pulled through the hole axially without destroying the head.

9. The elastomeric grommet as defined in claim 8 wherein the elastomeric grommet houses a lamp socket that includes a socket shell that is disposed inside the inner annular portion of the head, the socket shell being adapted to receive and retain a lamp bulb base.

10. An elastomeric grommet for passing a component through a hole of a panel that requires a relatively low engage force while producing a relatively high retention force comprising;

an elongated body having a head at one end that inserts through a round hole of uniform diameter extending through a panel for engaging a back side of the panel, the head having a tapered face that freely inserts part way into the hole and an outer diameter that exceeds the uniform diameter of the hole so that head engages the back side of the panel when the head is inserted through the hole to produce a relatively high retention force, the head having an inner annular portion and an outer portion comprising a plurality of ribs that are attached to the inner annular portion at their inner ends and shaped so that each rib extends radially from the inner annular portion and folds inwardly toward an adjacent rib in a trailing circumferential direction to reduce the outer diameter of the head responsive to twisting movement of the head in the round hole so that a relatively low engage force passes the head through the round hole, the elongated body having a cylindrical neck of reduced diameter behind the head that is sized to fit freely in the hole upon passage of the head through the hole, the elongated body having a shoulder that is integrally attached to the elongated body behind the cylindrical neck and is shaped to engage a front side of the panel and clamp the elastomeric grommet to the panel when the head is inserted through the hole in the panel to engage the backside of the panel, and the elongated body having a rearward section behind the shoulder that can be gripped manually for inserting the head into the hole and twisting and pushing the head in the hole so that the head passes through the hole.

11. The elastomeric grommet as defined in claim 10 wherein the elastomeric grommet has an imaginary centerline and the ribs are oblique in a plane transverse to the centerline.

12. The elastomeric grommet as defined in claim 10 wherein the ribs are thick oblique ribs that are necked inwardly so that the ribs fold inwardly toward each other in a trailing circumferential direction.

13. The elastomeric grommet as defined in claim 12 wherein the thick oblique ribs have concentric lands that define the outer diameter of the head.

* * * * *